US006543331B1

(12) United States Patent
Zingerman

(10) Patent No.: US 6,543,331 B1
(45) Date of Patent: Apr. 8, 2003

(54) HYDRAULIC LIFTING DEVICE

(76) Inventor: David Zingerman Zingerman, 1615 Wilcox Ave., Los Angeles, CA (US) 90068

( * ) Notice: Subject to any disclaimer, the term of this patent is extended or adjusted under 35 U.S.C. 154(b) by 125 days.

(21) Appl. No.: 09/809,372

(22) Filed: Mar. 15, 2001

(51) Int. Cl.[7] ..... F01B 1/00
(52) U.S. Cl. ..... 91/167 R; 91/519; 92/66
(58) Field of Search ..... 91/178, 519, 167 R; 92/66

(56) References Cited

U.S. PATENT DOCUMENTS 2,300,162 A * 10/1942 Maude ..... 91/519
3,362,299 A * 1/1968 Baron ..... 91/519
4,206,684 A 6/1980 Gosney et al.
4,684,103 A 8/1987 Baumann
4,726,281 A * 2/1988 De Filippi ..... 91/167 R
5,794,482 A * 8/1998 Walkin ..... 72/350

* cited by examiner

*Primary Examiner*—Edward K. Look
*Assistant Examiner*—Igor Kershteyn

(57) ABSTRACT

A hydraulic lifting device provides a lifting of the massive objects, having a complex geometric form and includes a support plate rigidly connected to the plungers coupled with the body carrying a main plunger, comprising a main rod and a main hydraulic fluid cavity, a main, auxiliary and central hydraulic fluid channels, a main valve and valve, and wherein each plunger comprises a road and hydraulic cavity.

1 Claim, 2 Drawing Sheets

15-15

15-15

HYDRAULIC LIFTING DEVICE

FIELD OF THE INVENTION

This invention relates to the hydraulic lifting devices and mostly for lifting of the massive objects, having a complex surface configuration, for example, a multi-plate surface.

BACKGROUND OF THE INVENTION

The devices for lifting of the massive objects have become specialized. Some of such devices are characterized by having the hydraulic or mechanical actuators.

For example, the hydraulic lifting device by U.S. Pat. No. 4,206,684 uses two hydraulic jacks coupled for operation in tandem for elevating large loads. When such hydraulic lifting system of two hydraulic jacks is to be raised, fluid is introduced through pipes to the interior cylinder member of each of two or more jacks. As a consequence, the piston members are raised. Hydraulic fluid from outer zone of the first hydraulic jack passes out port through one pipe to another pipe, which passes that fluid to the interior of sleeve member of the second hydraulic jack. This extends plunger member from sleeve member. The hydraulic fluid from outer zone of second jack passes through pipe of second jack to pipe of first jack which applies that hydraulic fluid to the interior of sleeve member of the first jack to extend plunger member out from sleeve member.

The use of such lifting system, requiring two or more separate lifting jacks coupled by outside hydraulic fluid pipes, is complex, expensive and requires more time for installation. Another U.S. Pat. No. 4,684,103 discloses the lifting mechanism, having a housing including a central opening to receive a pair of toggle means mounted between wall portions of housing. Each toggle means is comprised of one or more upper ball bearings mounted on a shaft between a pair of plates plus one or more lower ball bearings equally as well-supported by shafts between said plates. In a preferred configuration, both upper and lower bearings are spaced equal distance from a diaphragm plate capable of pushing the upper ball bearings down to a cause a free-tilting motion of said toggle means around the axis of bore. Diaphragm plate is supportive of an elastomeric diaphragm which in turn is clamped between housing and a cover. Plate is further opposed by a number of coiled compression springs. An air signal usually is administered through opening and under diaphragm forcing plate to lift.

This lifting mechanism is complex and has not provided the lifting load, having a complex multi-plate surface configuration.

Thus, there is a great need in the art for lifting device, providing the lifting of the massive loads, having a complex geometric form.

OBJECT AND ADVANTAGES OF THE INVENTION

Accordingly, several objects and advantages of the present invention are to provide the lifting, of the massive objects.

It is another object of the invention to provide the lifting of the massive objects, having a complex geometric form.

It is still another object of the invention to increase a carrying capacity of the lifting devices. It Is still further another object of the invention to reduce the time and expenses of the processes of the lifting device installation.

Still, further objects and advantages will become apparent from a consideration of the ensuing description accompanying drawings.

DESCRIPTION OF THE DRAWING

In order that the invention and the manner in which it is to be performed may be more clearly understood, embodiments thereof will be described by way of example with reference to the attached drawings, of which.

SUMMARY OF THE INVENTION

A hydraulic lifting device provides a lifting of the massive objects, having a complex geometric form. An improved hydraulic lifting device includes a support plate rigidly connected to the plungers coupled with the body carrying a main plunger. The main plunger and the plungers have a main rod and the roads respectively. Also, the improved hydraulic lifting device comprises the main, auxiliary and central hydraulic fluid channels and valves.

DESCRIPTION OF THE PREFERRED EMBODIMENTS

Here the description of an improved hydraulic lifting device will be done in statics (as if the components of the improved lifting device are suspended in the space) with description of their relative connections to each other. The description of the functional operations of an improved device will be done hereinafter.

Figure 1:
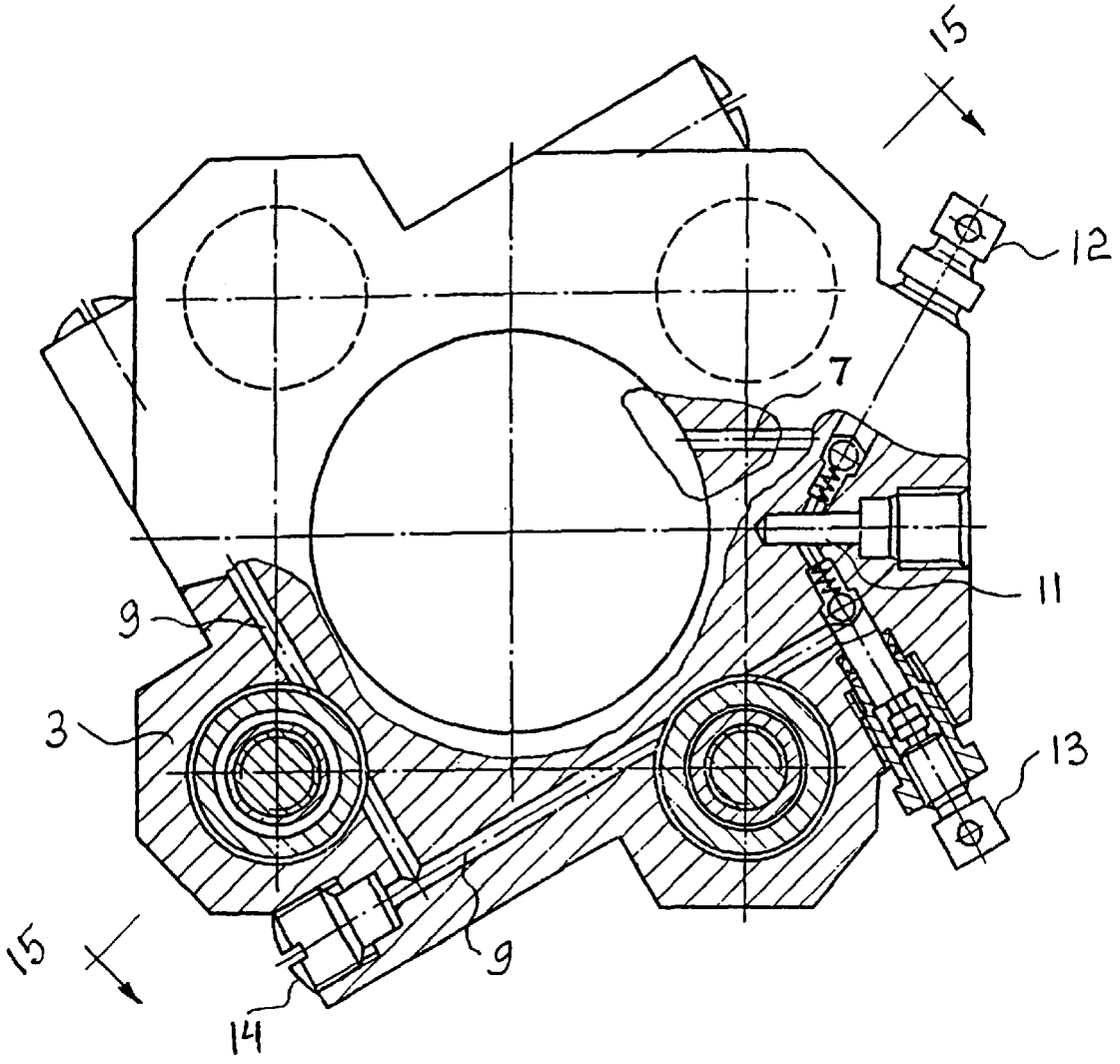
FIG. 1 is a simplified drawing of a top view of an improved hydraulic lifting device.

Referring to FIG. 1, an improved hydraulic lifting device includes a body 1, comprising a main plunger 2 and at least three of a plurality (N=3, 4, 5, . . . , j, . . . , n−1, n) of the plungers 3 (three plungers are placed at 120° each to other, four—at 90° and further as alike). The plungers 3 rigidly connected to a support plate 4. The body 1 also comprises the main plunger 2 including a main rod 5. Each plunger 3 includes the rod 6. The body 1 has a main hydraulic fluid channel 7 for the hydraulic fluid passage into a main hydraulic fluid cavity 8 and the auxiliary hydraulic channel 9 for the hydraulic fluid passage into each of "N" hydraulic fluid cavities 10.

Figure 2:
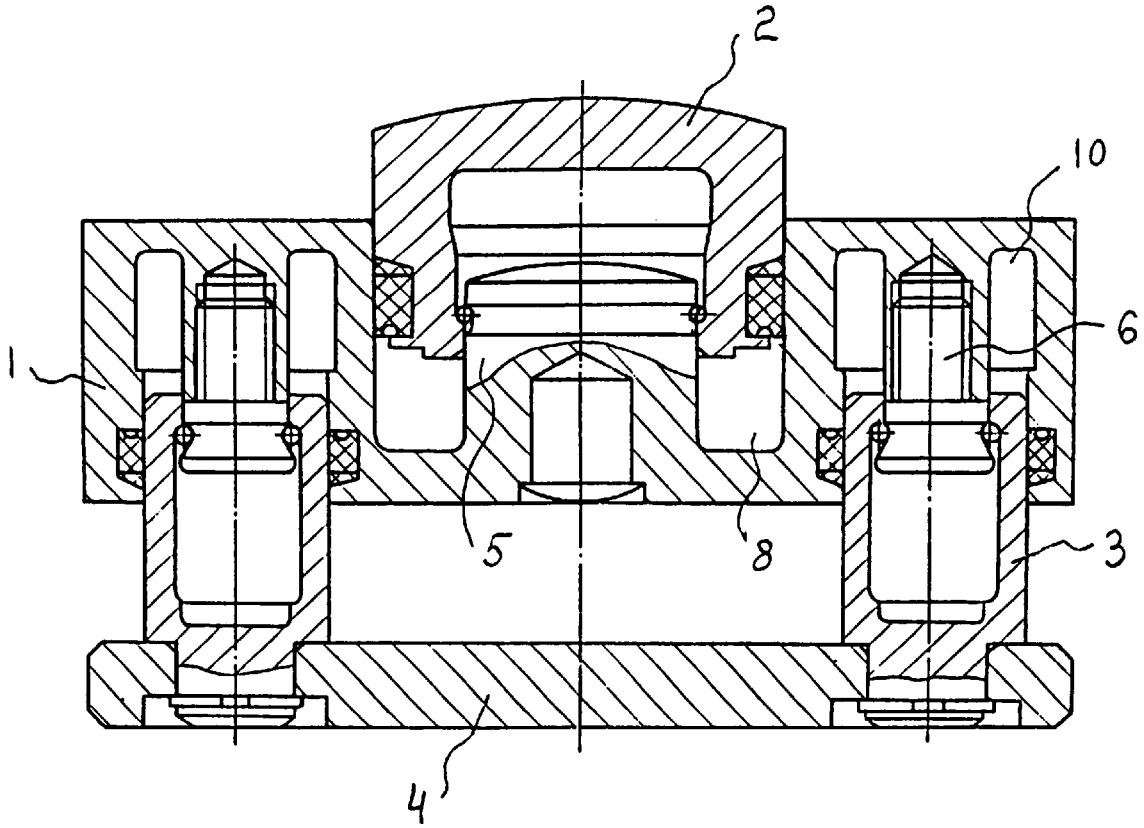
FIG. 2 is a simplified cross-sectional view of an improved hydraulic lifting device with the extended plungers.

As shown on FIG. 2, the channels 7 and 9 are coupled with a central hydraulic channel 11 by the main valves 12 and valve 13 respectively. Also, the improved hydraulic lifting device includes a hydraulic fluid drain 14.

The improved hydraulic lifting device operates as follows. The improved hydraulic lifting device can work in three modes: only the main plunger operates, only the plungers operate and the simultaneous operation of the main and plungers. According to the first mode, when the main valve 12 is opened (the valve 13 is closed) and the pressure is applied the hydraulic fluid flows by channel 7 into main cavity 8, thereby extending the main rod 5 in respect to the body 1. Regarding the second mode, when the valve 13 is opened (the main valve 12 is closed) and the pressure is applied the hydraulic fluid flows by channel 9 into all cavities 10 extending the body 1 in respect to the support plate 4. According to the third mode, the main valve 12 and the valve 13 are opened and the pressure is applied. The hydraulic fluid flows by the main channel 7 and auxiliary hydraulic fluid channel 9 into main hydraulic fluid cavity 8 and hydraulic fluid cavities 10 simultaneously, thereby simultaneously extending the body 1 and the main road 5.

Regarding to the third mode, when the lifting of the load on the desired height is completed, the vertical effort from the main plunger 2 is proportionally distributed via the main rod 5 and rods 6 of the "floating" body 1 to the main plunger 2 and plungers 3 respectively.

The combination of the first and second modes of the improved hydraulic lifting device is used for lifting the load, having a complex geometric configuration (e.g. multi-plate form massive objects).

CONCLUSION, RAMIFICATION AND SCOPE

Accordingly the reader will see that, according to the invention, I have provided a hydraulic lifting device for lifting of the massive objects. An improved hydraulic lifting device has various possibilities.

While the above description contains many specificities, these should be not construed as limitations on the scope of the invention, but as exemplification of the presently-preferred embodiments thereof. Many other ramifications are possible within the teaching to the invention. For example, an improved hydraulic lifting device provides simplification of the technological cycles of its installation and operation in the difficult-accessed areas, where the lifting of a complex multi-plate form load is needed and where the plurality of separate jacks can not be used.

Thus, the scope of the invention should be determined by the appended claims and their legal equivalents, and not by examples given.

What is claimed is:

1. A hydraulic lifting device including at least three of a plurality of plungers, each of which is rigidly connected to a support base of said hydraulic lifting device, and wherein said each of said plurality of plungers comprises a hydraulic fluid cavity and a rod;

a body coupled with said each of said plurality of plungers, and wherein said body comprises a main plunger, including a main hydraulic fluid cavity and a main rod;

a main hydraulic fluid channel, coupling said main hydraulic fluid cavity with a main valve;

an auxiliary hydraulic fluid channel, wherein each of the hydraulic fluid cavities is coupled each to the other and with a valve;

a central hydraulic fluid channel, coupling said main valve and said valve, and a hydraulic fluid drain connected to said auxiliary hydraulic fluid channel.

* * * * *